United States Patent [19]

Rachofsky et al.

[11] Patent Number: 4,926,400

[45] Date of Patent: May 15, 1990

[54] COMBINED TWENTY-FOUR (24)/TWENTY-FIVE (25) HOUR CLOCK

[76] Inventors: Morton Rachofsky, 5511 Stonegate Rd., Dallas, Tex. 75209; Guy B. Irving, 2017 Crestside Dr., Carrollton, Tex. 75007

[21] Appl. No.: 443,918

[22] Filed: Nov. 30, 1989

[51] Int. Cl.[5] ..... G04C 19/00

[52] U.S. Cl. ..... 368/82

[58] Field of Search ..... 368/76, 80, 82–84, 368/220–221, 223, 228, 232, 239–241

[56] References Cited

U.S. PATENT DOCUMENTS 4,540,292 9/1985 Rubenstein et al. ..... 368/82

4,541,726 9/1985 Rachofsky ..... 368/220

*Primary Examiner*—Vit W. Miska

*Attorney, Agent, or Firm*—David H. Judson

[57] ABSTRACT

A clock is provided for simultaneously displaying twenty-five (25) simulated time synchronized with twenty-four (24) real-time. Preferably, the clock comprises a digital processor for controlling the operation of the clock, a first display connected to the digital processor for displaying twenty-four (24) hour real-time representations and a second display located proximate to the first display and connected to the digital processor for displaying twenty-five (25) simulated time representations. A look-up table encoding technique is used to convert each twenty-four (24) hour real-time representation to a corresponding twenty-five (25) hour simulated time representation. In operation, a program display program is run by the digital processor to display the twenty-four (24) real-time representation on the first display and the twenty-five (25) hour simulated time representation on the second display.

7 Claims, 2 Drawing Sheets

COMBINED TWENTY-FOUR (24)/TWENTY-FIVE (25) HOUR CLOCK

TECHNICAL FIELD

The present invention relates generally to clock mechanisms, and more particularly to a clock for simultaneously indicating twenty-five (25) simulated hours as well as a twenty-four (24) hour real-time indication.

BACKGROUND OF THE INVENTION

A common complaint in today's fast-paced society is that there are not enough hours in the day to accomplish one's daily tasks. The cause of such complaint, however, is not of course due to an insufficient number of hours in a day; but rather one's failure to appropriately regulate his or her daily schedule or routine. This problem is exacerbated over time as one becomes conditioned to follow the same schedule or routine on a daily basis.

Scientific studies have confirmed that the human body tends to function on a twenty-five (25) hour biological system rather than the conventional twenty-four (24) hour system tied to the earth's rotation. The body's tendency to function on a twenty-five (25) hour biological clock, however, cannot be utilized advantageously since conventional timekeeping is tied to the twenty-four (24) hour real-time day. The twenty-five (25) hour biological clock does, however, suggest a way of ameliorating daily scheduling problems; using a twenty-five (25) simulated hour clock to provide a person with the feeling of having one extra hour per day to accomplish daily tasks.

There is therefore a need to provide a device to aid those people who are so inclined to regulate their schedules, routines and bodies to a day having twenty-five (25) simulated hours in a twenty-four (24) hour real-time day. One such device is shown in U.S. Pat. No. 4,541,726 to Rachofsky issued Sept. 17, 1985. In its preferred embodiment, this patent describes an analog clock having a clock face with twenty-five (25) equally-spaced intervals printed thereon. A suitable clock drive mechanism simultaneously drives a minute hand around the clock face, and an hour hand between spaced intervals, in 1/25th of the twenty-four (24) hour real-time day.

While the clock described in U.S. Pat. No. 4,541,726 has proven advantageous, there is a need to provide an improved clock that has the capability to simultaneously display both twenty-four (24) and twenty-five (25) hour time.

BRIEF SUMMARY OF THE INVENTION

Accordingly, the present invention describes a clock for indicating both twenty-five (25) simulated hours in a twenty-four (24) hour real-time day, as well as a standard twenty-four (24) real-time representation. The clock preferably includes a digital processor for controlling operation of the clock, a first display connected to the digital processor for displaying standard twenty-four (24) hour time, a second display proximate to the first display and also connected to the digital processor for displaying twenty-five (25) hour simulated time, and appropriate conversion means controlled by the digital processor for determining the proper twenty-five (25) hour time to be displayed based on the actual twenty-four (24) hour time. In particular, the conversion means includes a "lookup" table stored in suitable memory associated with the digital processor. The look-up table stores data for use in calculating the hours, minutes and seconds needed to represent the twenty-five (25) hour time based on the then-current twenty-four (24) hour time.

BRIEF DESCRIPTION OF THE DRAWINGS

For a more complete understanding of the present invention and the advantages thereof, reference is now made to the following Description, taken in conjunction with the accompanying Drawings in which.

Figure 1:
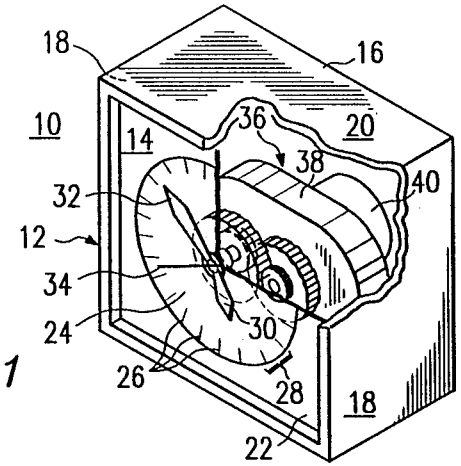
FIG. 1 is a perspective view of the twenty-five (25) hour clock for indicating twenty-five (25) simulated hours in a twenty-four (24) hour real-time day.
Figure 3:
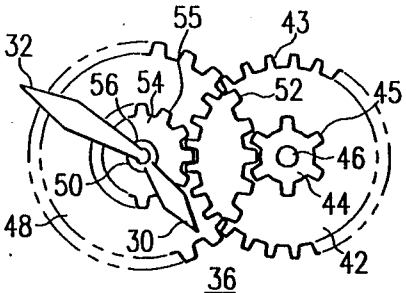
Figure 4:
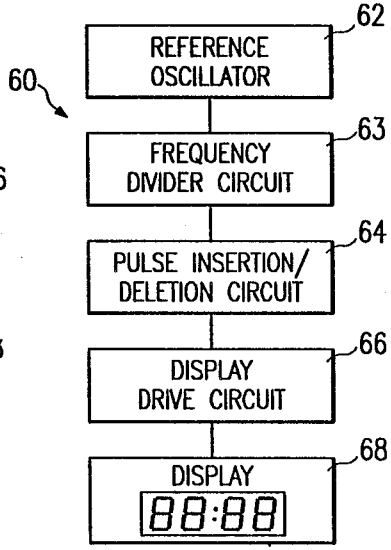
Figure 2C:
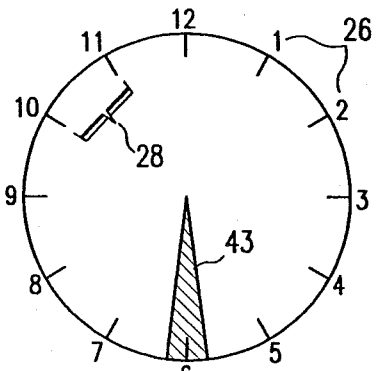
Figure 2B:
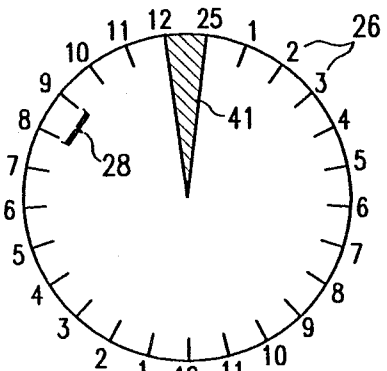
Figure 2A:
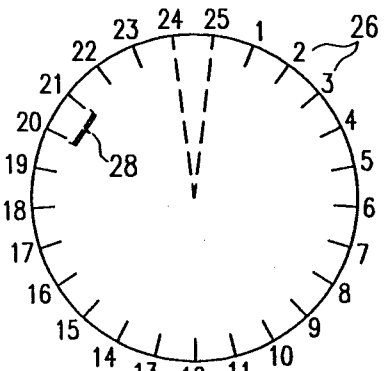
Figure 5:
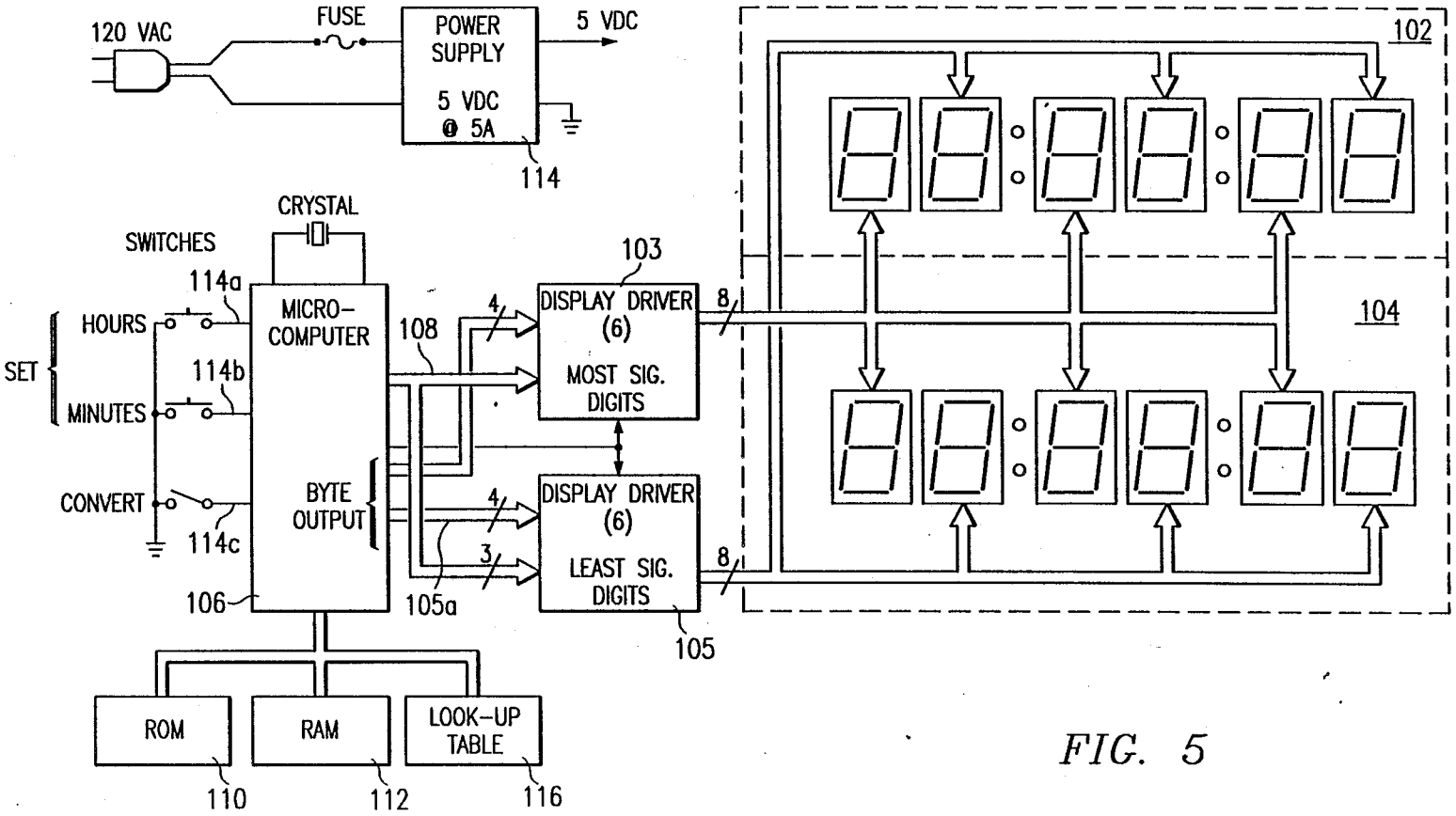

FIGS. *2a–c* show representative clock faces for use in the twenty-five (25) hour clock of FIG. 1;

FIG. 3 shows a schematic representation of a clock drive mechanism for driving the hour and minute hands of the clock in FIG. 1;

FIG. 4 shows a schematic representation of a suitable digital clock drive mechanism for driving a conventional digital readout for the twenty-five (25) hour clock; and FIG. 5 shows a schematic representation of an alternate embodiment of FIG. 4 wherein a pair of digital displays are used to provide a synchronized, simultaneous 24/25 hour readout.

DETAILED DESCRIPTION

With reference now to the FIGURES wherein like reference characters designate like or similar parts throughout the several views, FIG. 1 is a perspective view of the twenty-five (25) hour clock 10 as described in U.S. Pat. No. 4,541,726. This clock indicates twenty-five (25) simulated hours in a twenty-four (24) hour real-time day. As used herein, the term "twenty-four (24) hour real-time day" refers to the twenty-four (24) hour timekeeping convention tied to the earth's rotation. The clock 10 includes a housing 12 having front and back walls 14 and 16, side walls 18, top wall 20 and a base 22. Preferably, the clock includes a clock face 24 having indicia 26 printed thereon at twenty-five (25) equally-spaced intervals 28, each of the intervals representing a simulated "hour" in a twenty-five (25) hour simulated day. The clock 10 also includes a conventional hour hand 30, minute hand 32 and second hand 34. The clock hands 30, 32 and 34 are driven by a suitable clock drive mechanism 36 for simultaneously driving the hands around the clock face 24. Although not shown in detail, the clock drive mechanism 36 is driven through a gear reduction motor 38 by a suitable power source such as an electric motor 40. Equivalent types of power sources may be used in place of the electric motor 40 as is well known in the art. The clock 10 also preferably includes a conventional clock setting mechanism (not shown) for manual setting of the hour and minute hands 30 and 32. The clock setting mechanism allows the user to reset the clock movement at any convenient time of the twenty-four (24) hour real-time day.

As described in U.S. Pat. No. 4,541,726, the twenty-five (25) hour clock 10 may be used advantageously by those people who are so inclined to regulate their schedules, routines and bodies to a day having twenty-five (25) simulated hours in a twenty-four (24) hour real-time day. The clock allows tasks to be completed in a shorter time frame and gives a person the feeling of having one extra hour per day. This extra hour, although simulated, serves to increase task efficiency by a factor of over four (4%) percent.

The theory of operation of the twenty five hour clock 10 is seen by considering Table I below:

TABLE I

| Seconds | Minutes | Hours | Total Seconds/Day |
|---|---|---|---|
| 57.6 × | 60 × | 25 = | 86,400 (25 simulated hrs) |
| 60 × | 60 × | 24 = | 86,400 (24 real-time hrs) |

As seen in the above table, every minute in the twenty-five (25) simulated hour system includes only 24/25th's of a real-time minute, or 57.6 real-time seconds. Thus, the invention takes advantage of the saving of 2.4 real-time seconds every real-time minute to form the one extra simulated hour (57.6 real-time minutes long) every twenty-four (24) hour real-time day.

Referring simultaneously to FIGS. *2a–c*, various embodiments of the clock face 24 of the clock 10 are shown. In the preferred embodiment of FIG. *2a*, a "25 hour" clock face is shown wherein the indicia 26 comprise the sequential numerals "1–25" located at the twenty-five (25) equally-spaced intervals 28. Each of the intervals 28 represents a simulated "hour" in the twenty-five (25) hour simulated day, and each is separated by 14.4° (since 14.4°×25 intervals=360°). In FIG. *2b*, a "12-12 hour" clock face is shown wherein the indicia 26 comprise sets of sequential numerals "1–12" located on each side of the clock face 24, with an additional interval 41 representing the twenty-fifth (25) simulated hour in the twenty-five (25) hour simulated day.

In FIG. *2c*, the indicia 26 on the clock face 24 are located at twelve intervals, each of the intervals being 28.8° apart. An additional segment 43 of 14.4° is also used on this face to represent the extra simulated hour per day. This extra hour is allocated to one-half hour per each half day. Table II below sets forth the various timing (real-time) relationships among the clock faces 24 shown in FIGS. *2a–c*.

TABLE II

| | "25 Hour" | "12–12 Hour" | "12.5 Hour" |
|---|---|---|---|
| Hour Hand: | 1 rev./day | 1 rev./day | 2 rev./day |
| Minute Hand: | 1 rev./57.6 min. | 1 rev./57.6 min. | 1 rev./57.6 min. |
| Second Hand | 1 rev./57.6 sec. | 1 rev./57.6 sec. | 1 rev./57.6 sec. |

As shown in Table II, using the "12.5 hour" face of FIG. *2c*, the hour hand 30 makes two complete revolutions per twenty-four (24) hour real-time day. However, the minute hand 32 and second hand 34 move in the same fashion as with the twenty-five (25) hour clock faces of FIGS. *2a* and *2b*.

Referring now to FIG. 3, a suitable clock drive mechanism 36 is shown for the twenty-five (25) hour clock face of FIG. *2a*. As noted above, with the twenty-five (25) hour clock face, the hour hand 30 is driven at a speed of one revolution around the clock face 24 per twenty-four (24) hour real-time day. The minute hand 32 is driven at a speed of one revolution per 24/25th's real-time minutes. The hour hand 30 is thus driven between a "hour" interval in 1/25th of the twenty-four (24) hour real-time day.

Referring to FIG. 3, the clock drive mechanism 36 includes a gear wheel 42 and pinion 44 mounted on a spindle 46 for rotation therewith. The spindle 46 is driven by a suitable power source such as the electric motor 40 as described above with respect to FIG. 1. As also shown in FIG. 3, an hour wheel 48 is mounted on a spindle 50 to drive the hour hand 30 around the clock face. The hour wheel 48 includes teeth 52 which mesh with teeth 45 of the pinion 44, and thus the hour wheel 48 is driven thereby. Likewise, a minute wheel 54 is mounted on a spindle 56 to drive the minute hand 32. To this end, the minute wheel 54 includes teeth 55 which mesh with the teeth 43 of the gear wheel 42, and thus the minute wheel 54 is driven thereby. According to the present invention, once the speed of the electric motor 38 is determined, the circumference of the hour wheel 48 and the number of teeth 52 therein are appropriately sized to drive the hour hand 30 at a speed of one revolution around the clock face 24 per 24/25th's real-time minutes. Accordingly, the hour hand 30 moves between spaced intervals 28 in 1/25th of the twenty-four (24) hour real-time day. Likewise, the circumference of the minute wheel 54 and the number of teeth 55 therein are appropriately sized to drive the minute hand 32 around the clock face 24 in 24/25th of a real-time hour. Although not shown in FIG. 3, the second hand 34 also includes a second wheel which is appropriately sized to drive the second hand 34 of FIG. 1 around the clock face 24 in 24/25th's of a real-time minute. The clock drive mechanism 36 of FIG. 3 may also be utilized in conjunction with the clock face 24 shown in FIG. *2b* since the hour hand 30 therein also makes one revolution per twenty-four (24) hour real-time day. Although not shown in detail, the clock drive mechanism 36 may also be suitably modified to drive the hour hand 30 two times around the clock face 24 in a twenty-four (24) hour real-time day. In such an embodiment, the clock face 24 shown in FIG. *2c* is used.

Therefore, it can be seen that the present invention describes a unique clock mechanism for representing twenty-five (25) simulated hours in a twenty-four (24) hour real-time day. The twenty-five (25) hour clock is advantageous to those people who are so inclined to regulate their schedules, routines and bodies in such a way as to increase their efficiency by a factor of over four (4%) percent in a twenty-four (24) hour real-time day. To this end, the present invention may be used to assist a person in adjusting to a twenty-five (25) hour (57.6 real-time) minute cycle that allows tasks to be completed in a shorter time frame and provides a person with the feeling of having one extra hour per day.

Although in the preferred embodiment, the twenty-five (25) hour clock includes a clock face 24 having indicia printed thereon in twenty-five (25) equally-spaced intervals such as shown in FIGS. *2a–2b*, it should be appreciated that the clock face may also comprise a digital readout representing twenty-five (25) simulated hours.

Referring now to FIG. 4, a simplified schematic diagram is shown detailing a suitable digital clock drive mechanism 60 for use in an electronic version of the twenty-five (25) hour clock. The drive mechanism 60 includes a reference oscillator 62 generating a predetermined frequency. The output of the oscillator 62 is divided by a frequency divider circuit 63 and applied to a pulse insertion/deletion circuit 64. The pulse insertion/deletion circuit 64 is suitably controlled (by a microprocessor or other conventional control circuit) to insert or delete pulses as needed in the pulse train to generate a clock signal on line 65. The clock signal is appropriately selected to generate a 57.6 second "simulated minute" and a 57.6 minute "simulated hour". This clock signal is then supplied to a conventional display drive circuit 66 which drives an LCD or LED display 68. The actual display readout will reset to "00:00" at the beginning of the twenty-four (24) hour real-time day and go up to "24:59" at the end of the twenty-four (24) hour real-time day. Although not shown in detail, the drive mechanism is driven by a suitable power source, such as a rechargeable battery. The electronic version of the clock also includes a conventional clock setting mechanism.

In yet another embodiment shown in FIG. 5, a clock 100 includes first and second displays 102 and 104 for providing synchronized and simultaneous display of both twenty-four (24) hour time and twenty-five (25) simulated time. In the preferred embodiment, displays 102 and 104 are conventional seven-segment digital displays juxtaposed one above the other (or side-by-side) in a suitable "desktop" housing. Analog displays may alternatively be used if desired. Preferably, first display 102 indicates "standard" twenty-four (24) hour time as set by the user. The second display 104 indicates the corresponding twenty-five (25) hour time. Both displays are adapted to read "12:00:00" at precisely the same time at noon. Switch **114*a* is an "hour set" button used to set the hours on the first display and switch 114*b* is a "minutes set" button used to set the minutes on the first display as will be described. Third switch 114*c* allows the user to alternate between 12 and 24-hour (i.e., military time) formats. When switch 114*a* or switch 114*b*** is depressed and held, the respective display digits are quickly advanced to enable the user to set the time on the first display in a prompt manner.

The clock 100 further includes a crystal-driven central processing unit (CPU) 106 for controlling the overall operation of the clock. The CPU 106 includes data, address and control buses, generally represented by the bus 108. CPU 106 drives the first and second displays 102 and 104 through the first and second display drivers 103 and 105, respectively. As shown in FIG. 5, the most significant digits generated by CPU are used by display driver 103 (via bus **103*a*) to drive display 102 while the least significant digits 105 are used by display driver 105 (via bus 105*a*) to drive display 104. A read only memory (ROM) 110 is connected to the CPU 106 by the bus 108, as is random access memory (RAM) 112. ROM 110 stores the various operating and applications programs (to be further described) necessary to control the CPU 106. RAM 112 provides temporary storage of data processed by the CPU as is well known in the prior art. The clock further includes a suitable power supply 114 driven off a standard 117 volts a.c. wall outlet; alternatively, a suitable battery supply may be used for this purpose. When the clock 100 is powered on, the unit will reset and both displays will flash "12:00:00" until the first display 102** is set by the user.

The clock 100 also includes an electrically-eraseable programmable read only memory (EPROM) or equivalent semipermanent memory means 116 for storing a look-up table of data values used to convert twenty-four (24) hour real-time to an equivalent twenty-five (25) hour simulated time representation. The look-up table may alternatively be supported in the ROM 110. According to a feature of the present invention, a conversion routine (identified below as CAL25) is supported in the ROM 110 for continuously receiving the twenty-four hour real-time and using this value as an address to the look-up table where the appropriate twenty-five hour time information is stored. In the preferred embodiment, each display is updated every second of real-time. ROM 110 also includes suitable program routines for controlling the CPU 106 and display drivers 103 and 105 to generate the 24 hour and 25 hour displays.

As described above, the clock includes suitable control switches 114 for setting and blanking the displays. When the "hour set" button **114*a* is depressed, the twenty-five hour display is blanked and the hour portion of the twenty-four hour display is incremented by one hour. Likewise, when the "minute set" button 114*b* is depressed, the twenty-five hour display is blanked and the minute portion of the twenty-four (24) hour display is incremented. When the user releases a "set" button, the software quickly uses the look-up table setup in permanent memory to assist in calculation of the 25-hour time (based on the 24-hour time). This calculation is valid all the way down to the 50th of a second so the displays are always exactly relative. The 25-hour display is then promptly displayed and the clock returns to its normal display mode. Therefore, after setting the appropriate time on the twenty-four hour display, the CPU thus automatically recalculates the proper corresponding twenty-five (25) hour time and displays this time on the second display 104**.

The software routines for controlling the operation of the clock are identified below. The software uses an internal timer which runs at a rate of approximately 1/50 of a second. The 24-hour display is updated every 50 ticks of the timer while the 25-hour display is updated every 48 ticks.

RESET CODE: This code is only executed upon power-up (or power failure). Registers, data ports and the timer are all set-up. Then the displays flash 12:00:00 noon in a loop until a "set" button is pressed. The code reacts by jumping to the MAIN CODE.

MAIN CODE: This code is a simple loop which monitors activity at five events: flag set for increment of 24-hour display, flag set for increment of 25-hour display, "hour set" button **114*a* pressed, "minutes set" button 114*b* pressed, "convert" button 114*c*** pressed. Upon detection of any event the proper routine is called or flag set.

TIMER: (Interrupt routine): Each 50th of a second interval this routine is initiated by the internal timer. The routine calls DECTIMER and resets the timer to begin the next interval.

DECTIMER: The number of timer intervals is checked to see if either display is due for an update by one second. When a display is due to be updated the appropriate flag is set for the MAIN CODE. The displays are thus timed independently and allow the user a proper visual effect of the time ratio.

INCDIS24: Increments the 24-hour display registers and displays the new time. This operation is initiated by the flag from the timer.

INCDIS25: Increments the 25-hour display registers and displays the new 25-hour time. This operation is initiated by the flag from the timer.

INCHOUR: Increments the 24-hour display by one hour as a result of the "hour set" button being pressed. It also clears the seconds to "00" and recalculates the 25-hour time. Then both displays are updated. The 25-hour time is blanked while the button is pressed.

INCMIN: Same as INCHOUR except for the minutes as a result of the "minutes set" button being pressed.

INCCOUNT: Increments display register values by one second and allows it to trickle all the way up to the hours place.

DESCOUNT: Sends the display data out to the display devices.

DIS24: Checks for 12/24-hour time mode and formats the display data properly using conversion tables. Then DESCOUNT is called to output the proper 24-hour display.

DIS25: Same as DIS 24 except for the 25-hour display. In a "twelve hour" mode, the 25-hour display will run from 12:00:00 noon until 13:59:59 and then roll over to 1:00:00 AM.

DELAY: A simple delay routine for intervals in multiples of 100 milliseconds.

CAL25: Gets the 24-hour time, uses the look-up table and calculates the exact relative 25-hour time. The BCDADD routine is used to add time offsets if necessary. Finally the new 25-hour time is displayed using the DIS25 routine.

BCDADD: Adds the conversion table offsets to the 24-hour time in binary-coded-decimal format in order to get the proper 25-hour time.

The flowcharts showing the control relationship of the above routines are set forth below. The look-up table values for the twenty-four (24) hour to twenty-five (25) hour conversion are reproduced following these routines.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitution of parts and elements without departing from the spirit of the invention. Accordingly, the present invention is intended to encompass such rearrangements, modifications and substitutions of parts and elements as fall within the spirit and scope of the appended claims.

What is claimed is:

SOFTWARE MODULE HIERARCHY
The following diagram shows the 15 modules (routines) and their control relationship. Control lines flow down from the "calling" module. Summarized descriptions and flow diagrams of the modules may be found in following sections.
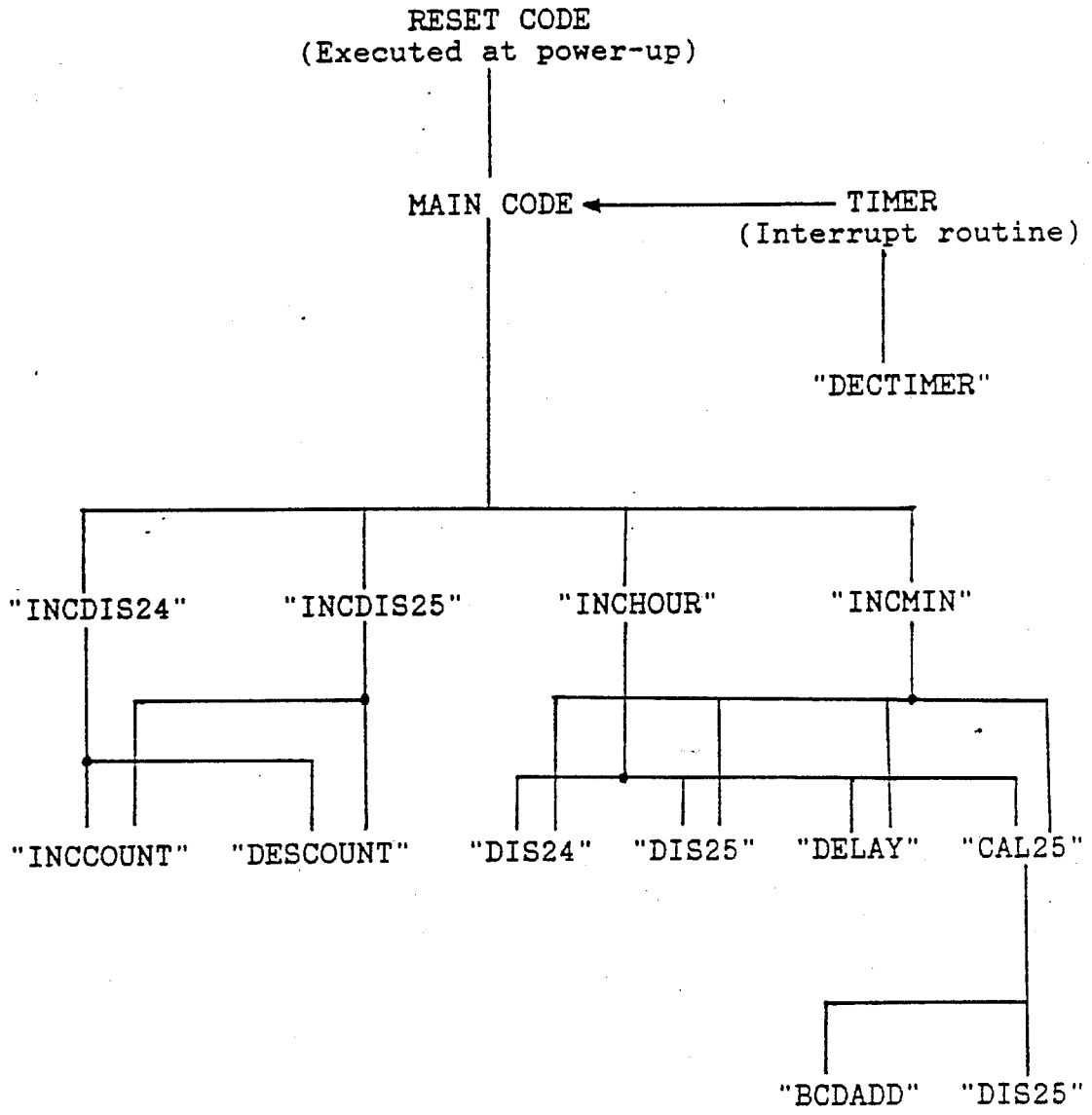

SOFTWARE MODULE FLOW DIAGRAMS

```
                RESET CODE
                ----------

            INTERRUPTS OFF
            RESET STACK POINTER
            INITIALIZE PORTS
            SET TIMER INTERVAL
            SET-UP TIMER CONTROL
                    |
            INITIALIZE DISPLAY REGISTERS
            (12:00:00)
                    |
            SET 25-HOUR CLOCK INTERVAL
            COUNT (48 TIMER INTERVALS)
                    |
            SET 24-HOUR CLOCK INTERVAL
            COUNT (50 TIMER INTERVALS)
                    |
            INITIALIZE FLAGS
                    |
            TURN ON DISPLAYS (12:00:00)
                    |
+--------> DELAY 300 MILLISECONDS
|                   |
|           SET BUTTON RELEASED ?
|               |         |
|               N         Y--------------------
|               |                              |
|           BLANK DISPLAYS                     |
|                   |                          |
|           DELAY 300 MILLISECONDS             |
|                   |                          |
|           TURN ON DISPLAY (12:00:00)         |
|                   |                          |
+-----------------+                            |
                                               |
                  +------------------------+
                  |
            RELOAD TIMER INTERVAL VALUE
            (1/50 SECOND)- STARTS TIMER
                  |
            ENABLE INTERRUPTS
                  |
        << JUMP TO MAIN CODE >>
```

MAIN CODE

```
+---------> 24-HOUR CLOCK INTERVAL FLAG SET?
|                 |                 |
|                 N                 Y
|                 |                 |
|                 |        BRANCH TO "INCDIS24" ROUTINE
|                 |
|           25-HOUR CLOCK INTERVAL FLAG SET?
|                 |                 |
|                 N                 Y
|                 |                 |
|                 |        BRANCH TO "INCDIS25" ROUTINE
|                 |
|           "HOURS SET" BUTTON PRESSED?
|                 |                 |
|                 N                 Y
|                 |                 |
|                 |        BRANCH TO "INCHOUR" ROUTINE
|                 |
|           "MINUTES SET" BUTTON PRESSED?
|                 |                 |
|                 N                 Y
|                 |                 |
|                 |        BRANCH TO "INCMIN" ROUTINE
|                 |
|           "CONVERT" BUTTON IN THE "ON" POSITION?
|                 |                 |
|                 N                 Y
|                 |                 |
|                 |        CLEAR CONVERT FLAG
|                 |        (24/25 HOUR MODE)
|                 |                 |
|           SET CONVERT FLAG        |
|           (12 HOUR MODE)          |
|                 |                 |
+<----------------+<----------------+
```

```
"TIMER" INTERRUPT ROUTINE
 ------------------------

RESET TIMER INTERRUPT BIT
          |
OPTIONAL TOGGLE OF PORT BIT
(TIMING ANALYSIS VIA SCOPE)
          |
TIMER ACCURACY COMPENSATION DELAY LOOP
          |
TIMER CONSTANT RELOAD
(STARTS TIMER COUNTING)
          |
BRANCH TO "DECTIMER" ROUTINE
          |
    << RETURN >>
```

```
 "DECTIMER ROUTINE"
  ----------------

DECREMENT 24-HOUR INTERVAL COUNTER
          |
24-HOUR INTERVAL COUNTER=0?  (50 TICKS)
     |                  |
     N                  Y
     |                  |
     |        RESTORE 24-HOUR INTERVAL (50)
     |        SET 24-HOUR CLOCK INTERVAL FLAG
     |                  |
     |<----------------+
     |
DECREMENT 25-HOUR INTERVAL COUNTER
          |
25-HOUR INTERVAL COUNTER=)?  (48 TICKS)
     |                  |
     N                  Y
     |                  |
     |        RESTORE 25-HOUR INTERVAL (48)
     |        SET 25-HOUR CLOCK INTERVAL FLAG
     |                  |
     |<----------------+
     |
<< RETURN >>
```

```
"INCDIS24"
--------

CLEAR 24-HOUR INTERVAL FLAG
        |
BRANCH TO "INCCOUNT" ROUTINE
        |
DID HOURS REGISTER ROLL OVER TO 24?
     |                  |
     N                  Y
     |                  |
     |          CLEAR 24-HOUR REGISTER  (00)
     |                  |
     |<----------------+
     |
"CONVERT" FLAG SET?
     |            |
     N            Y
     |            |
     |      (12 HOUR DISPLAY MODE)
     |      GET HOUR FROM CONVERT TABLE
     |      LOAD INTO 24-HOUR HOUR REGISTER
     |            |
     |<-----------+
     |
POINT TO ADDRESS FOR 24-HOUR CLOCK REGISTERS
     |
BRANCH TO "DESCOUNT" ROUTINE
(DISPLAY REGISTERS - UPDATE)
     |
RESTORE 24-HOUR HOURS REGISTER
     |
IS TIME PM?
 |       |
 N       Y
 |       |
 |    TURN ON "PM" LED INDICATOR
 |       |
 |<------+
 |
<< RETURN >>
```

```
"INCDIS25"
--------
```

SAME AS "INCDIS24" ABOVE EXCEPT FOR THE 25-HOUR CLOCK AND NO CHECK FOR "PM"

"INCCOUNT"

SIMPLE BCD ARITHMETIC ADDING ONE SECOND TO DISPLAY REGISTERS AND CHECKING FOR ROLLOVER OF MINUTES AND HOURS

"DESCOUNT"

START WITH POINTER TO SECONDS REGISTER OF ONE OF THE DISPLAYS. WRITE THREE CONSECUTIVE BYTES TO DISPLAY DRIVER DEVICES; SECONDS, MINUTES, AND HOURS.

"INCHOUR"

```
                 DELAY FOR SWITCH BOUNCE
                        |
                 SET SLOW COUNT
                 (SLOW DIGIT CHANGE W/ BUTTON PRESSED)
                 (4 DIGITS SLOWLY THEN FAST)
                        |
                 BLANK 25-HOUR DISPLAY
                        |
                 CLEAR 24-HOUR SECONDS REGISTER (00)
                        |
                 SET DELAY FOR DIGIT CHANGE
                 (800 MILLISECS FOR SLOW, 400 FOR FAST)
                        |
+----------> BRANCH TO "DELAY" ROUTINE
|                       |
|                "HOUR SET" BUTTON RELEASED?
|                   |              |
|                   N              Y--------------+
|                   |                             |
|     INCREMENT 24-HOUR HOURS REGISTER            |
|     (CHECK FOR ROLLOVER)                        |
|                   |                             |
----------------+                                |
                  +-------------------------+
                        |
                 BRANCH TO "CAL25" ROUTINE
                 (CALCULATE AND DISPLAY 25-HOUR DISPLAY)
                        |
                   << RETURN >>
```

"INCMIN"

SAME AS "INCHOUR" ROUTINE EXCEPT 24-HOUR MINUTES REGISTER IS INCREMENTED INSTEAD OF THE HOURS REGISTER

"DELAY"

GENERAL SOFTWARE DELAY LOOP. A DELAY OF 100 MILLISECONDS TIMES THE VALUE IN ACCUMULATOR OCCURS

"CAL25"

```
STORE 24-HOUR CLOCK INTERVAL COUNT (TICKS)
STORE 25-HOUR CLOCK INTERVAL COUNT
        |
STORE 25-HOUR CLOCK SECONDS AND MINUTES
        |
IS 24-HOUR CLOCK HOURS BETWEEN 12 AND 23?
    |                       |
    N                       Y---------------+
    |                                       |
DECREMENT 24-HOUR HOURS REGISTER VALUE      |
AND STORE IN 25-HOUR HOURS REGISTER         |
(24-HOUR CLOCK IS BEHIND DURING "AM")       |
    |                                       |
    |                                       |
    |                       +---------------+
    |                       |
    |          STORE 24-HOUR HOURS REGISTER
    |          IN 25-HOUR HOURS REGISTER
    |                       |
    |<----------------------+
    |
GET HOUR OFFSET FROM CONVERT TABLE
(USE 24-HOUR HOURS AS INDEX)
    |
BRANCH TO "BCDADD"  ROUTINE (ADD OFFSET)
    |
GET MINUTE OFFSET FROM CONVERT TABLE
(USE 24-HOUR HOURS AS INDEX IN DIFF TABLE)
    |
BRANCH TO "BCDADD" ROUTINE (ADD OFFSET)
    |
CHECK FOR ROLLOVER
    |
STORE NEW TIME IN 25-HOUR REGISTERS
    |
BRANCH TO "DIS25" ROUTINE
(TURN ON AND DISPLAY NEW 25-HOUR TIME)
    |
<< RETURN >>
```

```
"DIS25"
 -----

"CONVERT" FLAG SET?
  |            |
  N            Y
  |            |
  |      12 HOUR DISPLAY MODE
  |      FIND HOUR VALUE FROM CONVERT TABLE
  |      AND LOAD INTO 25-HOUR HOURS REGISTER
  |      (1:00 AM TO NOON, NOON TO 13:59:59)
  |            |
  |<-----------+
  |
BRANCH TO "DESCOUNT" ROUTINE
(DISPLAY 25-HOUR TIME)
  |
RESTORE 25-HOUR HOURS REGISTER
  |
<< RETURN >>
```

```
"DIS24"
 -----
SAME AS "DIS25" EXCEPT FOR THE 24-HOUR CLOCK
```

---------- ++ ----------

NOTE: CONVERSION TABLES MAY BE SEEN IN THE SOURCE CODE LISTINGS

```
AVOCET SYSTEMS 6805 CROSS-ASSEMBLER -  VERSION 1.07M

SOURCE FILE NAME: DISPLY2.ASM
                          PAGE  1


;
;
;       Twenty-Four/Twenty-Five hour display clock Firmware
;
;       Author:     John Balanchuk
;                   Guy Irving
;       Date:       15 August 1988
;       Version:    1.0
;       Processor:  Motorola 68705P3
;
;       File:     DISPLAY.ASM
;


;
;       EQUATES
;

PORTA:  EQU     0                   ; PORT A, B AND C MEMORY DATA AD

PORTB:  EQU     1
PORTC:  EQU     2
CNTRA:  EQU     4                   ; PORT A, B AND C CONTROL ADDRES

CNTRB:  EQU     5
CNTRC:  EQU     6
TDR:    EQU     8                   ; TIMER DATA REGISTER
TCR:    EQU     9                   ; TIMER CONTROL REGISTER
PBCNT:  EQU     $8F                 ; PORT B CONTROL INITALIZATION
PCCNT:  EQU     $00                 ; PORT C CONTROL INITALIZATION

;
;       RAM STORAGE DEFINITIONS
;

        ORG     $10

FLAG:   DS      1                   ; BIT0        = INC 24-HR (ACTIV

                                    ; BIT1        = INC 25-HR (ACTIV

                                    ; BIT2        = BUTTON FAST (ACT

                                    ; BIT3        = MODE (1-12HR, 0-

                                    ; BIT4 - BIT7 = NOT USED

CNT24HR: DS     1                   ; INTERUPT COUNTER 24-HR
CNT25HR: DS     1                   ; INTERRUPT COUNTER 25-HR

DS24SEC: DS     1                   ; 24-HR DISPLAY SECONDS
DS24MIN: DS     1                   ; 24-HR DISPLAY MINUTES
DS24HR:  DS     1                   ; 24-HR DISPLAY HOURS

DS25SEC: DS     1                   ; 25-HR DISPLAY SECONDS
DS25MIN: DS     1                   ; 25-HR DISPLAY MINUTES
```

```
        LDA     #PCCNT          ; SET UP PORT C "IIIIIIII"
        STA     CNTRC

;
;       25 HOUR TIMMER SECOND = .9999572571 SEC
;               4/3.579545MHZ * 140 * 128       * 49        + 18,

;           4/CLOCK FREQUENCY * TDC * PRESCALER * CNT24HR-1  LAS

;

        LDA     #140            ; SET TIMER COUNT
        STA     TDR
        LDA     #$0F            ; SET TIMER CONTROL REGISTER
        STA     TCR

        CLR     DS24SEC         ; INITALIZE CLOCK LOCATIONS
        CLR     DS24MIN
        CLR     DS25SEC
        CLR     DS25MIN
        LDA     #$12
        STA     DS24HR
        STA     DS25HR

        LDA     #48             ; INITALIZE TIMER INT COUNT 25-H

        STA     CNT25HR
        LDA     #50             ; INITALIZE TIMER INT COUNT 24-H

        STA     CNT24HR

        CLR     FLAG            ; INITALIZE FLAG BYTE
        JSR     DIS24           ; DISPLAY TIME
        JSR     DIS25

;
;       CLOCK MUST BE SET BEFORE BEGIN
;

CLKSET0:
        LDA     #03             ; DELAY (300 MS)
        JSR     DELAY

        BRCLR   4,PORTB,CLKSET2 ; CHECK IF BUTTON PRESSED
        BRCLR   5,PORTB,CLKSET2

        LDA     #$0FF           ; BLANK ALL DISPLAYS
        LDX     #$80
        JSR     WRLED

        LDA     #$03            ; DELAY (300 MS)
        JSR     DELAY

        BRCLR   4,PORTB,CLKSET2 ; CHECK IF BUTTON PRESSED
        BRCLR   5,PORTB,CLKSET2

        JSR     DIS24           ; DISPLAY TIME
        JSR     DIS25

        BRA     CLKSET0
```

```
CLKSET2:

        LDA     #140            ; SET TIMER COUNT AGAIN
        STA     TDR

        CLI                     ; ENABLE INTERUPTS
        BRA     MAIN02

;
;       MAIN CODE
;

MAINLOOP:
        BRCLR   0,FLAG,MAIN01   ; TEST FOR 24-HR SECOND COUNT
        BSR     INCDIS24        ; YES SECOND HAS CHANGED
MAIN01:
        BRCLR   1,FLAG,MAIN02   ; TEST FOR 25-HR SECOND COUNT
        JSR     INCDIS25        ; YES SECOND HAS CHANGED
MAIN02:
        BRSET   5,PORTB,MAIN03  ; TEST FOR HOUR SET BUTTON
        JSR     INCHOUR         ; YES BUTTON PUSHED
MAIN03:
        BRSET   4,PORTB,MAIN04  ; TEST FOR MINUTES SET BUTTON
        JSR     INCMIN          ; YES BUTTON PUSHED
MAIN04:
        BRCLR   6,PORTB,MAIN05  ; TEST FOR CONVERT BUTTON
        BSET    3,FLAG
        BRA     MAIN06
MAIN05:
        BCLR    3,FLAG

MAIN06:                         ; RAPID CLOCK RATE FOR TEST ONLY

        LDA     #PBCNT          ; RESET PORT B
        STA     CNTRB

        LDA     #PCCNT          ; SET UP PORT C "IIIIIIII"
        STA     CNTRC

        BRSET   0,PORTC,MAIN10
        SEI
MAIN07:                         ; ** PROTOTYPE ONLY
        JSR     DECTIMER
        BRCLR   0,FLAG,MAIN08
        BSR     INCDIS24
MAIN08:                         ; ** PROTOTYPE ONLY
        BRCLR   1,FLAG,MAIN09
        BSR     INCDIS25
MAIN09:                         ; ** PROTOTYPE ONLY
        LDA     #PCCNT          ; SET UP PORT C "IIIIIIII"
        STA     CNTRC

        BRCLR   0,PORTC,MAIN07
        CLI
MAIN10:
        BRA     MAINLOOP        ; DO IT AGAIN AND AGAIN ...

;
;       TIMER INTERUPT ROUTINE
;
```

```
TIMER:
        BCLR    7,TCR           ; RESET TIMER INTERUPT BIT
        BSR     DECTIMER        ; DECREMENT.COUNTERS
        LDA     #140            ; LOAD TDR WITH NORMAL COUNT
        STA     TDR
        LDA     CNT24HR         ; CHECK IF LAST COUNT
        DECA
        BNE     TIMER1
        LDA     #132            ; SET TDR FOR LAST COUNT
        STA     TDR
TIMER1:
        RTI                     ; RETURN FROM INTERUPT

;
;       DECREMENT COUNTERS SUBROUTINE
;

DECTIMER:
        DEC     CNT24HR         ; DECREMENT 24-HR COUNTER
        BNE     DECTIM01        ; BRANCH IF NOT ZERO
        LDA     #50             ; RESTORE COUNT
        STA     CNT24HR
        BSET    0,FLAG          ; SET 24-HR FLAG
DECTIM01:
        DEC     CNT25HR         ; DECREMENT 25-HR COUNTER
        BNE     DECTEND         ; BRANCH IF NOT ZERO
        LDA     #48             ; RESTORE COUNT
        STA     CNT25HR
        BSET    1,FLAG          ; SET 25-HR FLAG
DECTEND:
        RTS                     ; RETURN FROM SUBROUTINE

;
;       INCREMENT AND DISPLAY 24-HR COUNTERS SUBROUTINE
;
;       INCREMENT 24-HR CLOCK
;

INCDIS24:
        BCLR    0,FLAG          ; CLEAR 24-HR FLAG
        LDX     #DS24SEC        ; LOAD INDEX REGISTER
        BSR     INCCOUNT        ; INC COUNTERS
        LDA     #$24            ; CHECK IF HOUR ROLLED OVER
        CMP     DS24HR
        BNE     DIS24           ; BRANCH IF NO ROLL OVER
        CLR     DS24HR          ; ROLLED OVER CLEAR COUNTER

;
;       DISPLAY 24-HR CLOCK
;

DIS24:
        BRCLR   3,FLAG,DIS241   ; CHECK FOR 12 HOUR MODE

        LDX     DS24HR
        STX     MODE
        LDA     CNVTBL24,X
        STA     DS24HR
DIS241:
        LDA     PORTB
        AND     #$8
```

```
        ORA     #$83            ; SET ADDRESS FOR DISPLAY
        LDX     #DS24SEC        ; LOAD INDEX REGISTER
        BSR     DESCOUNT        ; DISPLAY COUNTERS

        BRCLR   3,FLAG,DIS242   ; CHECK FOR 12 HOUR MODE
        LDA     MODE
        STA     DS24HR
DIS242:
        LDA     DS24HR          ; CHECK IF AM OR PM
        SUB     #$12
        BCS     DIS243
        BCLR    3,PORTB
        BRA     DIS244
DIS243:
        BSET    3,PORTB
DIS244:
        RTS                     ; RETURN FROM SUBROUTINE

;
;       INCREMENT AND DISPLAY 25-HR COUNTERS SUBROUTINE
;
;       INCREMENT 25-HR CLOCK
;

INCDIS25:
        BCLR    1,FLAG          ; CLEAR 25-HR FLAG
        LDX     #DS25SEC        ; LOAD INDEX REGISTER
        BSR     INCCOUNT        ; INC COUNTERS
        LDA     #$25            ; CHECK IF HOUR ROLLED OVER
        CMP     DS25HR
        BNE     DIS25           ; BRANCH IF NO ROLL OVER
        CLR     DS25HR          ; ROLLED OVER CLEAR COUNTER

;
;       DISPLAY 25-HR CLOCK
;

DIS25:
        BRCLR   3,FLAG,DIS251   ; CHECK FOR 12 HOUR MODE

        LDX     DS25HR
        STX     MODE
        LDA     CNVTBL25,X
        STA     DS25HR
DIS251:
        LDA     PORTB
        AND     #$8
        ORA     #$80            ; SET ADDRESS FOR DISPLAY
        LDX     #DS25SEC        ; LOAD INDEX REGISTER
        BSR     DESCOUNT        ; DISPLAY COUNTERS

        BRCLR   3,FLAG,DIS252   ; CHECK FOR 12 HOUR MODE
        LDA     MODE
        STA     DS25HR
DIS252:
        RTS                     ; RETURN FROM SUBROUTINE

;
;       INCREMENT HR, MIN AND SEC COUNTERS SUBROUTINE
;
```

```
INCCOUNT:
        INC     ,X              ; INC COUNTER
        LDA     #$0F            ; CHECK IF COUNTER EQUALS $xA
        AND     ,X
        CMP     #$0A
        BNE     INCEND          ; BRANCH IF != $xA
        LDA     #$06            ; INC MSN OF BYTE
        ADD     ,X
        STA     ,X
        CMP     #$60            ; CHECK IF ROLL OVER TO NEXT BYT

        BNE     INCEND          ; BRANCH IF NO
        CLR     ,X              ; SET UP FOR NEXT BYTE
        INCX
        BRA     INCCOUNT        ; DO IT AGAIN
INCEND:
        RTS                     ; RETURN FROM SUBROUTINE

;
;       DISPLAY HR, MIN AND SEC COUNTERS SUBROUTINE
;

DESCOUNT:
        STA     PORTB           ; STORE ADDRESS BYTE
DESLOOP:
        LDA     ,X              ; STORE DATA BYTE
        STA     PORTA
        BCLR    7,PORTB         ; WRITE DATA TO DISPLAYS
        BSET    7,PORTB
        INC     PORTB           ; SET UP FOR NEXT ADDRESS
        INCX                    ; GET NEXT DATA BYTE
        LDA     PORTB           ; CHECK IF LAST DATA BYTE
        AND     #$87
        CMP     #$83
        BEQ     DESEND          ; BRANCH IF FINISHED
        CMP     #$86            ; CHECK IF LAST DATA BYTE
        BNE     DESLOOP         ; DO IT AGAIN
DESEND:
        RTS                     ; RETURN FROM SUBROUTINE

;
;       HOUR BUTTON PRESSED SUBROUTINE
;

INCHOUR:
        NOP                     ; DELAY FOR DEBOUNCE
        NOP
        NOP
        NOP
        NOP

        BCLR    2,FLAG          ; CLEAR FAST FLAG
        LDA     #4              ; SET SLOW COUNT
        STA     SLOWCNT

        LDA     #PBCNT          ; ** SET PORTB CONTROL BYTE AGAI

        STA     CNTRB           ; THIS NEEDS TO BE IN HERE

        BRSET   5,PORTB,INCHEND ; VERIFY THAT BUTTON IS STILL PR

        BSET    6,TCR           ; INHIBIT TIMER INTERUPTS
```

```
        LDA     #$FF            ; BLANK 25 HR DISPLAYS
        STA     DS25HR
        STA     DS25MIN
        STA     DS25SEC
        JSR     DIS25

        LDA     #$00            ; CLEAR 24 HR SEC'S
        STA     DS24SEC
        JSR     DIS24
        BRA     INCH02
INCH00:
        LDA     #04             ; SET SHORT DELAY (400 MS)
        BRSET   2,FLAG,INCH01   ; JUMP IF SHORT DELAY
        BSET    2,FLAG          ; CHECK IF LAST LONG DELAY
        DEC     SLOWCNT
        BEQ     INCH01
        LDA     #08             ; SET LONG DELAY (800 MS)
        BCLR    2,FLAG
INCH01:
        JSR     DELAY           ; DELAY REG Ax100MS SEC'S

        LDA     #PBCNT          ; ** SET PORTB CONTROL BYTE AGAI

        STA     CNTRB           ; THIS NEEDS TO BE IN HERE BECAU

                                ; IT DOESENT WORK OTHER WISE (GO


        BRSET   5,PORTB,INCHEND ; CHECK IF BUTTON RELEASED
INCH02:
        INC     DS24HR          ; INC 24 HR HOURS
        LDA     DS24HR
        CMP     #$24
        BNE     INCH03
        CLR     DS24HR
        BRA     INCH04
INCH03:
        AND     #$0F            ; BCD - FIX IF IT = 0xA
        CMP     #$0A
        BNE     INCH04
        LDA     DS24HR
        ADD     #$06
        STA     DS24HR
INCH04:
        JSR     DIS24           ; DISPLAY 24 HR'S
        BRSET   5,PORTB,INCHEND ; CHECK IF BUTTON RELEASED
        BRA     INCH00          ; DO IT AGAIN

INCHEND:
        LDA     #PBCNT          ; RESTORE PORT B CONTROL
        STA     CNTRB
        JSR     CAL25           ; CALCULATE AND DISPLAY 25 HR CL

        BCLR    6,TCR           ; ENABLE TIMER INTERRUPTS
        RTS

;
;       MIN BUTTON PRESSED SUBROUTINE
;

INCMIN:
        NOP                     ; DELAY FOR DEBOUNCE
```

```
        NOP
        NOP
        NOP
        NOP

        BCLR    2,FLAG          ; CLEAR FAST FLAG
        LDA     #4              ; SET SLOW COUNT
        STA     SLOWCNT

        LDA     #PBCNT          ; ** SET PORTB CONTROL BYTE AGAI

        STA     CNTRB           ; THIS NEEDS TO BE IN HERE

        BRSET   4,PORTB,INCMEND ; VERIFY THAT BUTTON IS STILL PR

        BSET    6,TCR           ; INHIBIT TIMER INTERUPTS

        LDA     #$FF            ; BLANK 25 HR DISPLAYS
        STA     DS25HR
        STA     DS25MIN
        STA     DS25SEC
        JSR     DIS25

        LDA     #$00            ; CLEAR 24 HR SEC'S
        STA     DS24SEC
        JSR     DIS24
        BRA     INCM02
INCM00:
        LDA     #01             ; SET SHORT DELAY (100 MS)
        BRSET   2,FLAG,INCM01   ; JUMP IF SHORT DELAY
        BSET    2,FLAG          ; CHECK IF LAST LONG DELAY
        DEC     SLOWCNT
        BEQ     INCM01
        LDA     #08             ; SET LONG DELAY (800 MS)
        BCLR    2,FLAG
INCM01:
        BSR     DELAY           ; DELAY REG Ax100MS SEC'S

        LDA     #PBCNT          ; ** SET PORTB CONTROL BYTE AGAI

        STA     CNTRB           ; THIS NEEDS TO BE IN HERE

        BRSET   4,PORTB,INCMEND ; CHECK IF BUTTON RELEASED
INCM02:
        INC     DS24MIN         ; INC 24 HR MINUTES
        LDA     DS24MIN
        AND     #$0F
        CMP     #$0A
        BNE     INCM04
        LDA     DS24MIN         ; BCD - FIX IF IT = 0xA
        ADD     #$06
        CMP     #$60            ; CHECK FOR MIN ROLL OVER
        BNE     INCM03
        CLRA
INCM03:
        STA     DS24MIN
INCM04:
        JSR     DIS24           ; DISPLAY 24 HR'S
        BRSET   4,PORTB,INCMEND ; CHECK IF BUTTON RELEASED
        BRA     INCM00          ; DO IT AGAIN
```

```
INCMEND:
        LDA     #PBCNT          ; RESTORE PORT B CONTROL
        STA     CNTRB
        BSR     CAL25           ; CALCULATE AND DISPLAY 25 HR CL

        BCLR    6,TCR           ; ENABLE TIMER INTERRUPTS
        RTS

;
;       DELAY 100MS
;       ENTRY - A = NUMBER OF 100MS DELAYS
;

DELAY:
        STA     TEMP            ; 4 SAVE COUNT

;       LDA     #PBCNT          ; 2 ** SET PORTB CONTROL BYTE AG

;       STA     CNTRB           ; 4 THIS NEEDS TO BE IN HERE

        LDA     PORTB           ; 4 SAVE BUTTON VALUES
        AND     #$30            ; 2
        STA     TEMP+2          ; 4 IN TEMP+2 (HR AND MIN SET)
DELAY1:
        LDX     #12             ; 2
        CLR     TEMP+1          ; 6
DELAY2:
;       LDA     #PBCNT          ; 2 ** SET PORTB CONTROL BYTE AG

;       STA     CNTRB           ; 4 THIS NEEDS TO BE IN HERE BEC

                                ;   IT DOESENT WORK OTHER WISE (


        LDA     PORTB           ; 4 TEST IF BUTTONS CHANGED STAT

        AND     #$30            ; 2
        CMP     TEMP+2          ; 4
        BNE     DELAY3          ; 4 END IF THEY HAVE

        DEC     TEMP+1          ; 6 DECREMENT DELAY COUNTER
        BNE     DELAY2          ; 4

        DECX                    ; 4
        BNE     DELAY2          ; 4

        DEC     TEMP            ; 6 DECREMENT COUNT
        BNE     DELAY1          ; 4
DELAY3:
02D3 81                 RTS                     ; 6


;
;       CALCULATE AND DISPLAY 25 HOUR CLOCK
;

CAL25:
        LDA     #50             ; STORE 24 HOUR TICKS
        STA     CNT24HR
        LDX     DS24MIN         ; STORE 25 HOUR TICKS
        LDA     MINTBLT,X
        STA     CNT25HR
        LDA     MINTBLS,X       ; STORE 25 HOUR SECONDS
```

```
        STA     TEMP
        LDA     MINTBLM,X       ; STORE 25 HOUR MIN
        STA     TEMP+1

        LDA     DS24HR          ; MOVE 24 HOUR VALUE
        STA     TEMP+2
        SUB     #$12            ; CHECK IF HOUR IS BETWEEN 12 AN

        BCC     CAL2501
        DEC     TEMP+2          ; HOUR IS BETWEEN 0 AND 11
        LDA     TEMP+2          ; CHECK IF HOUR = F
        CMP     #$0F
        BNE     CAL2500
        LDA     #$09
        STA     TEMP+2
CAL2500:
        LDA     DS24HR          ; DECREMENT TEMP+2 HR
        CMP     #00
        BNE     CAL2501         ; SET HOUR TEMP+2 TO 24 IF HOUR

        LDA     #$24
        STA     TEMP+2
CAL2501:
        LDX     DS24HR          ; ADD HR TABLE OFFSET TO TEMP BU

        LDA     HRTBLS,X
        LDX     #TEMP
        BSR     BCDADD

        LDX     DS24HR
        LDA     HRTBLM,X
        LDX     #TEMP+1
        BSR     BCDADD

        LDA     TEMP+2          ; CHECK FOR ROLL OVER TO '0A' OR

        AND     #$0F
        CMP     #$0A
        BNE     CAL2502
        LDA     TEMP+2
        AND     #$F0
        ADD     #$10
        STA     TEMP+2
CAL2502:
        LDA     TEMP+2          ; CHECK FOR ROLL OVER TO "0 O'CL

        SUB     #$25
        BCS     CAL2503
        STA     TEMP+2
CAL2503:
        LDA     TEMP            ; MOVE NEW 25 HOUR CLOCK TIME
        STA     DS25SEC         ; TO DS25XX STORAGE
        LDA     TEMP+1
        STA     DS25MIN
        LDA     TEMP+2
        STA     DS25HR

        JSR     DIS25           ; DISPLAY 25 HR CLOCK
        RTS

;
;       BCD ADDITION
;
```

```
;       ENTRY - A = NUMBER TO ADD
;               X = LOCATION OF TOTAL
;

BCDADD:
        CLR     COUNTER
        ADD     ,X                      ; ADD OFFSET AND ADJUST IF NESSE

        STA     ,X
        AND     #$0F
        SUB     #$0A
        BCS     BCDADD01
        LDA     ,X
        SUB     #$0A
        ADD     #$10
        STA     ,X
BCDADD01:
        LDA     ,X
        SUB     #$60
        BCS     BCDADD02
        INC     COUNTER
        STA     ,X
        BRA     BCDADD01
BCDADD02:
        INCX
        LDA     ,X
        ADD     COUNTER
        STA     ,X
        RTS

;
;       WRITE PATTERN TO ALL DISPLAYS
;

WRLED:
        STA     PORTA                   ; STORE VALUE IN DATA PORT
        STX     PORTB                   ; STORE ADDRESS IN ADDRESS PORT
WRLED0:
        BCLR    7,PORTB                 ; WRITE DATA
        BSET    7,PORTB
        INC     PORTB                   ; INC ADDRESS
        LDA     PORTB                   ; CHECK IF LAST WRITE
        AND     #7
        CMP     #0
        BNE     WRLED0

        RTS

;
;       EXTERNAL INTERUPT
;

EXTERN:
        RTI

;
;       SOFTWARE INTERUPUT
;

SWI_INT:
        RTI
```

```
;
;       25 HOUR HR CONVERSION TABLE
;

HRTBLM:                                 ; MINUNITES TABLE
        DB      30H,32H,35H,37H,40H,42H,45H,47H,50H,52H
        DB      0,0,0,0,0,0
        DB      55H,57H
        DB      00H,02H,05H,07H,10H,12H,15H,17H
        DB      0,0,0,0,0,0
        DB      20H,22H,25H,27H
HRTBLS:                                 ; SECONDS TABLE
        DB      00H,30H,00H,30H,00H,30H,00H,30H,00H,30H
        DB      0,0,0,0,0,0
        DB      00H,30H
        DB      00H,30H,00H,30H,00H,30H,00H,30H
        DB      0,0,0,0,0,0
        DB      00H,30H,00H,30H

;
;       25 HOUR MIN SET TABLE
;

MINTBLM:                                ; MINUTES TABLE
        DB      00H,01H,02H,03H,04H,05H,06H,07H,08H,09H
        DB      0,0,0,0,0,0
        DB      10H,11H,12H,13H,14H,15H,16H,17H,18H,19H
        DB      0,0,0,0,0,0
        DB      20H,21H,22H,23H,25H,26H,27H,28H,29H,30H
        DB      0,0,0,0,0,0
        DB      31H,32H,33H,34H,35H,36H,37H,38H,39H,40H
        DB      0,0,0,0,0,0
        DB      41H,42H,43H,44H,45H,46H,47H,48H,50H,51H
        DB      0,0,0,0,0,0
        DB      52H,53H,54H,55H,56H,57H,58H,59H,60H,61H
        DB      0,0,0,0,0,0
        DB      62H
MINTBLS:                                ; SECONDS TABLE
        DB      00H,02H,05H,07H,10H,12H,15H,17H,20H,22H
        DB      0,0,0,0,0,0
        DB      25H,27H,30H,32H,35H,37H,40H,42H,45H,47H
        DB      0,0,0,0,0,0
        DB      50H,52H,55H,57H,00H,02H,05H,07H,10H,12H
        DB      0,0,0,0,0,0
        DB      15H,17H,20H,22H,25H,27H,30H,32H,35H,37H
        DB      0,0,0,0,0,0
        DB      40H,42H,45H,47H,50H,52H,55H,57H,00H,02H
        DB      0,0,0,0,0,0
        DB      05H,07H,10H,12H,15H,17H,20H,22H,25H,27H
        DB      0,0,0,0,0,0
        DB      30H
MINTBLT:                                ; TICKS TABLE
        DB      48,24,48,24,48,24,48,24,48,24
        DB      0,0,0,0,0,0
        DB      48,24,48,24,48,24,48,24,48,24
        DB      0,0,0,0,0,0
        DB      48,24,48,24,48,24,48,24,48,24
        DB      0,0,0,0,0,0
        DB      48,24,48,24,48,24,48,24,48,24
        DB      0,0,0,0,0,0
        DB      48,24,48,24,48,24,48,24,48,24
        DB      0,0,0,0,0,0
        DB      48,24,48,24,48,24,48,24,48,24
        DB      0,0,0,0,0,0
        DB      48
```

```
;
;       CONVERT TABLES
;

CNVTBL24:                                   ; CONVERT TABLE FROM 24H

        DB      12H,0F1H,0F2H,0F3H,0F4H,0F5H,0F6H,0F7H,0F8H,0F9H
        DB      0,0,0,0,0,0
        DB      10H,11H,12H,0F1H,0F2H,0F3H,0F4H,0F5H,0F6H,0F7H
        DB      0,0,0,0,0,0
        DB      0F8H,0F9H,10H,11H

CNVTBL25:                                   ; CONVERT TABLE FROM 25H

        DB      13H,0F1H,0F2H,0F3H,0F4H,0F5H,0F6H,0F7H,0F8H,0F9H
        DB      0,0,0,0,0,0
        DB      10H,11H,12H,0F1H,0F2H,0F3H,0F4H,0F5H,0F6H,0F7H
        DB      0,0,0,0,0,0
        DB      0F8H,0F9H,10H,11H,12H

;
;
;       MOR BYTE
;

        ORG     $0784

        DB      $07

;
;       INTERUPT VECTORS
;

        ORG     $07F8

        DW      TIMER           ; TIMER INTERUPT
        DW      EXTERN          ; EXTERNAL INTERUPT
        DW      SWIINT          ; SOFTWARE INTERUPT
        DW      RESET           ; RESET INTERUPT

        END
```

1. A clock for simultaneously displaying twenty-five (25) hour simulated time synchronized with twenty-four (24) hour real-time, comprising:

a digital processor for controlling the operation of the clock;

a first display connected to the digital processor for displaying twenty-four (24) hour real-time representations;

a second display located proximate to the first display and connected to the digital processor for displaying twenty-five (25) simulated time representations;

storage means connected to the digital processor for storing data for use in converting twenty-four (24) hour real-time representations to their corresponding twenty-five (25) hour simulated time representations;

program control means controlled by the digital processor for receiving a twenty-four (24) hour real-time representation and generating a corresponding twenty-five (25) hour simulated time representation; and program display means responsive to the program control means for displaying the twenty-four (24) real-time representation on the first display and the twenty-five (25) hour simulated time representation on the second display.

2. The clock as described in claim 1 further including switch means for setting the first display.

3. The clock as described in claim 2 wherein the switch means for setting the first display includes an hour set button and a minute set button.

4. The clock as described in claim 2 further including means for blanking the second display when the first display is updated.

5. The clock as described in claim 1 wherein the storage means is a look-up table.

6. The clock as described in claim 1 further including switch means for converting the first display from a twenty-four hour format to a twelve hour format.

7. The clock as described in claim 1 further including means for powering the digital processor.

* * * * *